US009327344B2

(12) United States Patent
Hu

(10) Patent No.: US 9,327,344 B2
(45) Date of Patent: May 3, 2016

(54) LASER ASSISTED CASTING OF COOLING HOLE AND RELATED SYSTEM

(71) Applicant: General Electric Company, Schenectady, NY (US)

(72) Inventor: Zhaoli Hu, Greer, SC (US)

(73) Assignee: General Electric Company, Schenectady, NY (US)

( * ) Notice: Subject to any disclaimer, the term of this patent is extended or adjusted under 35 U.S.C. 154(b) by 156 days.

(21) Appl. No.: 14/075,155

(22) Filed: Nov. 8, 2013

(65) Prior Publication Data

US 2015/0129152 A1 May 14, 2015

(51) Int. Cl.
*B22C 7/02* (2006.01)
*B22C 9/04* (2006.01)

(52) U.S. Cl.
CPC .... *B22C 7/02* (2013.01); *B22C 9/04* (2013.01)

(58) Field of Classification Search
CPC ..... B22C 7/02; B22C 9/04; B22C 9/24
USPC ..... 164/34, 35, 44, 45, 235, 246, 516–529, 164/18–24
See application file for complete search history.

(56) References Cited

U.S. PATENT DOCUMENTS 4,806,729 A 2/1989 Holmes et al.
4,915,757 A * 4/1990 Rando ..... B29C 67/0074 156/155
5,747,769 A 5/1998 Rockstroh et al.
5,880,430 A 3/1999 Wein
6,355,907 B1 3/2002 Kuehnle et al.
6,767,499 B1 7/2004 Hory et al.
7,721,784 B2 * 5/2010 Lehmann ..... B22C 7/02 164/4.1
2002/0144798 A1 10/2002 Ounjian et al.
2006/0144549 A1 7/2006 Lehmann et al.

FOREIGN PATENT DOCUMENTS

EP 1102138 A1 5/2001
JP 2003025044 A 1/2003

OTHER PUBLICATIONS

Liu et al., "Laser ablation and Micromachining with ultrashort laser pulses," IEEE Journal of Quantum Electronics, vol. 33, No. 10, pp. 1706-1716, Oct. 1997.*
GB Search Report and Written Opinion issued in connection with corresponding GB Application No. GB1419868.3 dated Dec. 17, 2014.
European Search Report and Opinion issued in connection with corresponding EP Application No. 14190401.1, on Apr. 21, 2015.
Office Action for U.S. Appl. No. 14/075,094, dated Sep. 17, 2015, 17 pages.

(Continued)

*Primary Examiner* — Kevin E Yoon
(74) *Attorney, Agent, or Firm* — Ernest G. Cusick; Hoffman Warnick LLC

(57) ABSTRACT

Various embodiments include methods and related systems for laser-assisted casting. Some embodiments include a method including: performing laser ablation to a preliminary wax casting model to form a modified wax model including at least one cooling hole absent from the wax casting substrate; coating the modified wax model to form a mold shape around the modified wax model; and removing the modified wax model to leave a casting mold including the at least one cooling hole.

12 Claims, 3 Drawing Sheets

(56) References Cited

OTHER PUBLICATIONS

Office Action for U.S. Appl. No. 14/075,114, dated Sep. 17, 2015, 15 pages.
Office Action for U.S. Appl. No. 14/075,196, dated Sep. 17, 2015, 14 pages.
U.S. Appl. No. 14/075,094, Final Office Action 1 dated Jan. 6, 2016, 15 pages.
U.S. Appl. No. 14/075,114, Notice of Allowance dated Jan. 14, 2016, 15 pages.
U.S. Appl. No. 14/075,196, Notice of Allowance dated Jan. 20, 2016, 16 pages.

* cited by examiner

LASER ASSISTED CASTING OF COOLING HOLE AND RELATED SYSTEM

CROSS-REFERENCE TO RELATED APPLICATIONS

This application is related to co-pending U.S. patent application Ser. Nos. 14/075,094, 14/075,114 and 14/075,196, filed on Nov. 8, 2013, each of which is hereby incorporated by reference in its entirety.

FIELD OF THE INVENTION

The subject matter disclosed herein relates to material processing. More particularly, the subject matter relates to casting shapes in materials.

BACKGROUND OF THE INVENTION

Casting of parts, e.g., metal parts for use in machinery such as turbomachinery and/or dynamoelectric machinery, is conventionally performed by forming a mold of a shape, and pouring or otherwise depositing a liquefied material (e.g., metal) into the mold. The liquefied material is then cooled to form a solidified part in the shape of the opening in the mold. The mold is conventionally formed by creating a wax shape, coating the wax shape, e.g., with one or more ceramic layers, and removing the wax to leave the outline of that shape as the mold for casting the liquefied material.

Particular shapes in parts can be difficult and/or costly to form, as the wax base material used to form those shapes is not always easy to manipulate. In some cases, a "base" (or, general) wax base material is formed, and cooling holes are then added to the wax model by machining that wax base material to form the features that will be coated and later shape the part. This process can be expensive, time consuming and complex.

Other approaches include adding features to the wax molding tool that forms the shape of the wax model prior to forming the mold. This can be quicker that modifying after forming the wax model, but can be expensive due to the need to re-form the entire wax molding tool. Additionally, modifying the original wax molding tool can cause conflict between features, e.g., features that extend in different directions. Sub-wax models and compilations of wax models can also be used, but these approaches form seams that require correction after the fact.

BRIEF DESCRIPTION OF THE INVENTION

Various embodiments include methods and related systems for laser-assisted casting. Some embodiments include a method including: performing laser ablation to a preliminary wax casting model to form a modified wax model including at least one cooling hole absent from the preliminary wax casting model; coating the modified wax model to form a mold shape around the modified wax model; and removing the modified wax model to leave a casing mold including the at least one cooling hole.

A first aspect of the invention includes a method including: performing laser ablation to a preliminary wax casting model to form a modified wax model including at least one cooling hole absent from the preliminary wax casting model; coating the modified wax model to form a mold shape around the modified wax model; and removing the modified wax model to leave a casing mold including the at least one cooling hole.

A second aspect of the invention includes a system having: a laser system programmed to perform laser ablation to a preliminary wax casting model to form a modified wax model including at least one cooling hole absent from the preliminary wax casting model; an imaging system including an optical trepanning system for scanning the modified wax model to image the at least one cooling hole after the performing of the laser ablation; a coating system for coating the modified wax model to form a mold shape around the modified wax model, and removing the modified wax model to leave a casting mold including the at least one cooling hole; and a casting system for casting a shape from a casting material using the casting mold having the at least one cooling hole.

A third aspect of the invention includes a method including: performing laser ablation to a preliminary wax casting model to form a modified wax model including at least one cooling hole absent from the preliminary wax casting model, wherein the performing of the laser ablation includes applying a pulsed laser to the preliminary wax casting model to directly vaporize a portion of the preliminary wax casting model, forming the at least one cooling hole, wherein the directly vaporizing includes: increasing a local temperature of the portion of the preliminary wax casting model above approximately 500 degrees Celsius; and maintaining a temperature of an adjacent portion of the preliminary wax casting model below approximately 120 degrees Celsius; and scanning the modified wax model to image the at least one cooling hole after the performing of the laser ablation.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
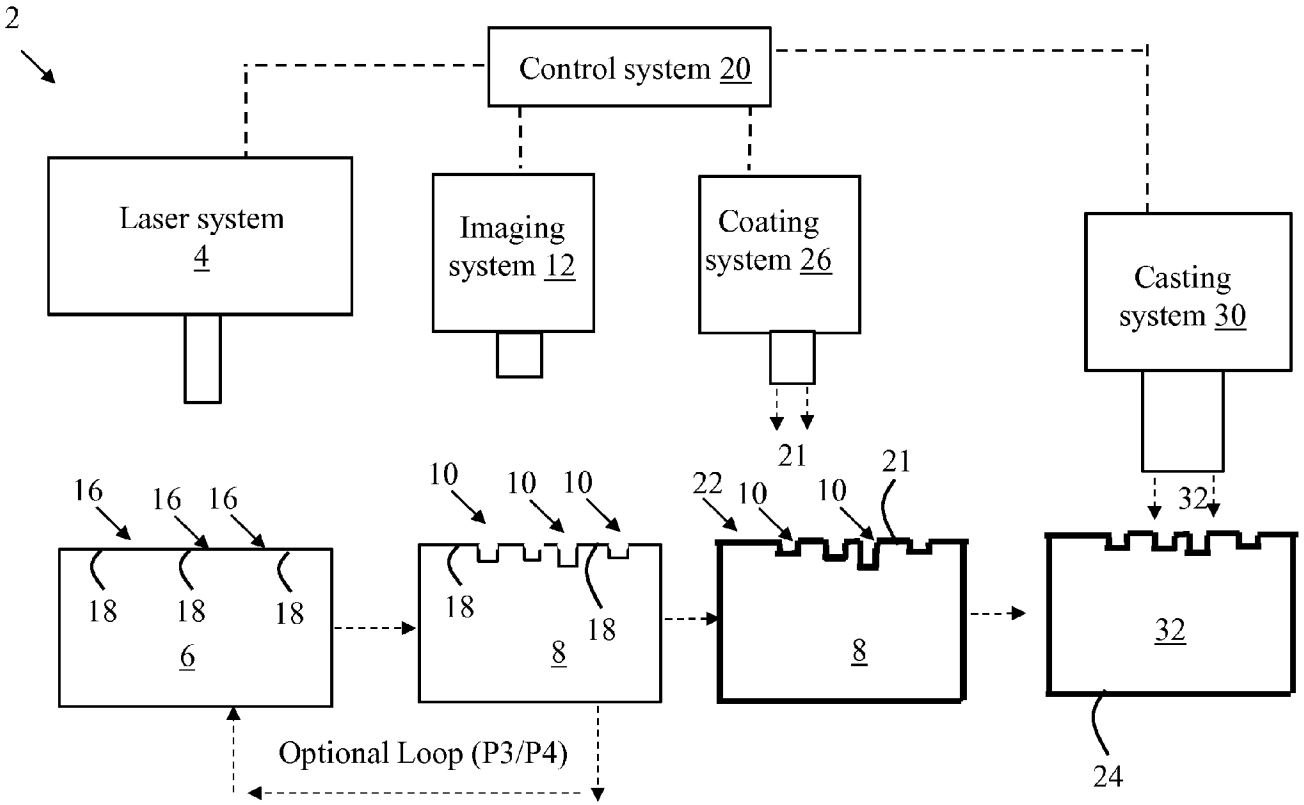
FIG. 1 shows a schematic depiction of a system for laser-assisted casting according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates material processing. More particularly, the subject matter relates to casting shapes in materials.

As described herein, particular shapes in parts can be difficult and/or costly to form, as the wax base material used to form those shapes is not always easy to manipulate. In some cases, a "base" (or, general) wax base material is formed, and cooling holes are then added to the wax model by machining that wax base material to form the features that will be coated and later shape the part. This process can be expensive, time consuming and complex.

In particular, conventional casting of turbomachinery parts includes building a wax molding tool, which includes the shape of a wax model to be poured. Following building of the wax molding tool, wax is poured into the tool to create the wax model. That wax model is then coated (e.g., in a coating slurry with as many as 20-30 layers) to make a shell (mold shape) around the wax model. The shell (mold shape) including the wax is then heated to remove the wax model, retaining the mold shape (as a casting mold). A heated metal is then poured into the mold shape (shell), and subsequently cooled to form a metal part in the shape of the wax model. The mold shape (shell) is then removed, e.g., via mechanical or chemical removal. Some conventional approaches attempt to add features to the wax molding tool prior to forming the wax model. This can be quicker that modifying after forming the wax model, but can be expensive due to the need to re-form the entire wax molding tool. Additionally, modifying the original wax molding tool can cause conflict between features, e.g., features that extend in different directions. Sub-wax models and compilations of wax models can also be used, but these approaches form seams that require correction after the fact.

In order to address issues with the conventional molding/casting approaches, various aspects of the invention include solutions for effectively modifying an existing mold to include cooling holes.

When there is a desire for higher-aspect-ratio features, such as deep trenched shapes or holes, there is a strict requirement on laser beam power density used to form those features. In these types of applications, ultra-short-pulse laser beams, e.g., picosecond or femtosecond lasers, are considered to provide satisfactory resolution to form such features. Further, appropriate collimation and focusing is needed to provide necessary Rayleigh length and beam quality/power density, plus an optical trepanning head is needed to provide circulation. When the high-aspect-ratio features are created in the wax model, a pressure-assisted slurry process can be used to ensure those features will be duplicated in the finished metal piece. When compared with the convention process of leaving those features blank (unformed) during casting and then post-machine the features after casting, the laser-assisted casting procedures described with reference to various embodiments herein reduces the cost in making casting core and tooling, increases the yield rate, and significantly reduces the time and cost in post-processing of turbomachine components.

It is understood that as described herein, the term "cooling hole" can refer to an aperture having an aspect ratio measured from a surface of the wax model of approximately one (1) to approximately (10), in particular cases, approximately 5 to approximately 10.

Various particular aspects of the invention include a method including: providing a preliminary wax casting model (optional pre-process); performing laser ablation to the preliminary wax casting model to form a modified wax model including at least one cooling hole absent from the preliminary wax casting model; coating the modified wax model to form a mold shape around the modified wax model; and removing the modified wax model to leave a casing mold including the at least one cooling hole.

Various additional particular aspects of the invention includes a system having: a laser system programmed to perform laser ablation to a preliminary wax casting model to form a modified wax model including at least one cooling hole absent from the preliminary wax casting model; an imaging system including an optical trepanning system for scanning the modified wax model to image the at least one cooling hole after the performing of the laser ablation; a coating system for coating the modified wax model to form a mold shape around the modified wax model, and removing the modified wax model to leave a casting mold including the at least one cooling hole; and a casting system for casting a shape from a casting material using the casting mold having the at least one cooling hole.

Other aspects of the invention includes a method including: providing a preliminary wax casting model (optional pre-process); performing laser ablation to the preliminary wax casting model to form a modified wax model including at least one cooling hole absent from the preliminary wax casting model, wherein the performing of the laser ablation includes applying a pulsed laser to the preliminary wax casting model to directly vaporize a portion of the preliminary wax casting model, forming the at least one cooling hole, wherein the directly vaporizing includes: increasing a local temperature of the portion of the preliminary wax casting model above approximately 500 degrees Celsius; and maintaining a temperature of an adjacent portion of the preliminary wax casting model below approximately 120 degrees Celsius; and scanning the modified wax model to image the at least one cooling hole after the performing of the laser ablation.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, may inherently contain certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

FIG. 1 shows a schematic depiction of a system 2 for laser assisted casting according to various embodiments of the invention. As shown, the system 2 can include a laser system 4 programmed to perform laser ablation to a preliminary wax casting model 6 to form a modified wax model 8 including at least one cooling hole 10 absent from the preliminary wax casting model 6. The preliminary wax casting model 6 can include a raw, unworked, or otherwise unmachined piece of wax material, as described herein. The preliminary wax casting model 6 is formed in a wax molding tool, as is known in the art. The system 2 can also include an imaging system 12 for scanning the modified wax model 8 to image the at least one cooling hole 10 after laser ablation has been performed by the laser system 4. In various embodiments, the imaging system 12 includes a rotating scanning system, for example, an optical trepanning system configured to scan features of the at least one cooling hole 10. The imaging system 12 including an optical trepanning system can have a resolution of less than approximately at 0.0001 inch (0.00254 centimeter) tolerance. The system 2 can further include a coating system 26 for: a) coating the modified wax model 8 (e.g., with a coating metal) to form a mold shape (or, shell) around the modified wax model 8, and b) removing the modified wax model 8 to leave a casting mold 24 (also referred to as a casting shell) including the at least one cooling hole 10. The system 2 can also include a casting system 30 for pouring a casting material 32 to form a shape from the casting mold 24 (after the modified wax model 8 is verified to have desired characteristics, and the casting mold 24 is formed).

In various embodiments, the system 2 can include a control system 20 coupled to the laser system 4, coating system 26, casting system 30 and/or the imaging system 12. The control system 20 can be configured to provide instructions to, and/or otherwise control operation of the laser system 4, coating system 26, casting system 30 and/or imaging system 12. The control system 20 may be mechanically or electrically connected to the laser system 4, coating system 26, casting system 30 and/or the imaging system 12. Control system 20 may be a computerized, mechanical, or electro-mechanical device capable of controlling the laser system 4, coating system 26, casting system 30 and/or the imaging system 12. In one embodiment, control system 20 may be a computerized device capable of providing operating instructions to the laser system 4, coating system 26, casting system 30 and/or the imaging system 12. In another embodiment, control system 20 may include a mechanical device, capable of use by an operator. In this case, the operator may physically manipulate control system 20 (e.g., by pulling a lever), which may actuate the laser system 4, coating system 26, casting system 30 and/or the imaging system 12. In another embodiment, control system 20 may be an electro-mechanical device.

Figure 2:
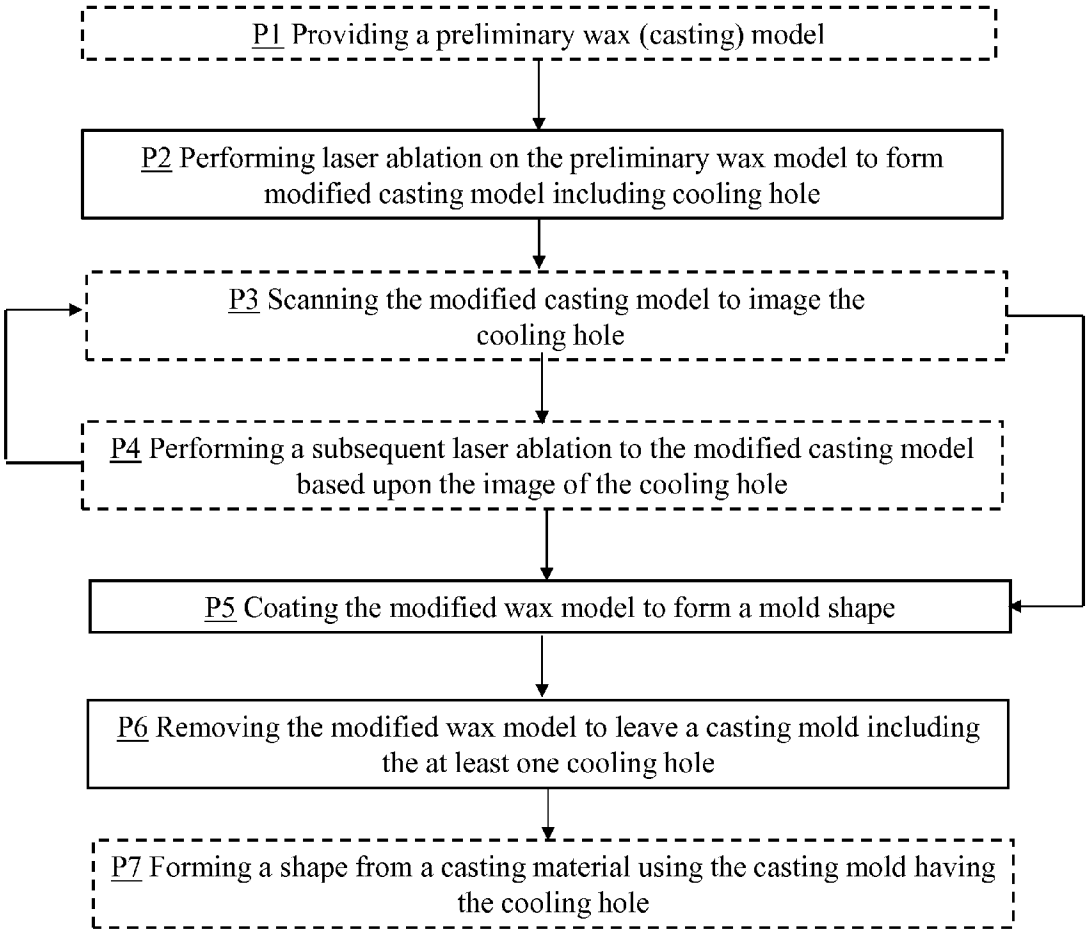
FIG. 2 is a flow diagram illustrating processes according to various embodiments of the invention.

Turning to FIG. 2, with continuing reference to FIG. 1, a flow diagram is shown illustrating a method of laser assisted casting performed according to various embodiments. As shown, the method can include the following processes:

Process P1 (optional pre-process): providing a preliminary wax casting model, e.g., preliminary wax casting model 6 (FIG. 1). In various embodiments, the preliminary wax casting model 6 can include hydrocarbon wax, natural ester wax, synthetic wax, natural resins, synthetic resins, organic filler materials, water and mixtures thereof. In particular embodiments, the preliminary wax casting model 6 can include aliphatic compounds (compounds having straight chained carbon atoms, e.g., hydrocarbon wax, natural ester wax, synthetic wax and/or resins) or aromatic compounds (compounds, fillers and/or resins having ring structured carbon atoms).

Process P2: performing laser ablation (using laser system 4) to the preliminary wax casting model 6 to form a modified casting model (e.g., modified casting model 8) including at least one cooling hole (e.g., cooling hole(s) 10) absent from the preliminary wax casting model 6. As described herein, the process of performing laser ablation on the preliminary wax casting model 6 can include applying a pulsed laser (e.g., an ultra-short-pulse laser) to the preliminary wax casting model 6 to directly vaporize a portion 16 of the preliminary wax casting model 6, forming the at least one cooling hole 10. The vaporized portions 16 are illustrated by the cooling holes 10 in the modified casting model 8. In various embodiments, the process of directly vaporizing includes increasing a local temperature of the portion 16 of the preliminary wax casting model 6 above the evaporation temperature of the preliminary wax casting model 6, e.g., approximately 500 degrees Celsius (and in some cases, up to approximately 1,000 degrees Celsius), while maintaining a temperature of the adjacent portion 18 of the preliminary wax casting model 6 below its melting temperature, e.g., approximately 120 degrees Celsius (and in some cases, below approximately 50 degrees Celsius). It is understood that as described herein, a cooling hole 10 can be formed in the preliminary wax casting model 6 by modulating at least one of the following features of the laser system 4: laser pulse duration, power density of the laser pulses, and scanning speed of the laser over the preliminary wax casting model 6 to form the cooling hole 10 having an aspect ratio of approximately one (1) to approximately ten (10). This process may differ from forming an additional feature having a greater aspect ratio, e.g., greater than approximately 10. In particular embodiments, the cooling hole 10 includes an aperture having an aspect ratio of approximately 5 to approximately 10.

Process P3: scanning the modified casting model 8 (using imaging system 12 including optical trepanning system) to image the at least one cooling hole 10 after the performing of the laser ablation. In various embodiments, the scanning includes performing an optical trepanning scan of the at least one cooling hole 10.

Process P4 (optional in some embodiments): performing a subsequent laser ablation (using laser system 4) to the modified casting model 8 based upon the image of the at least one cooling hole 10. In various embodiments, the subsequent laser ablation process includes a modified laser ablation approach including modifying at least one parameter of the laser system 4 when compared with the initial laser ablation parameter(s), for example: a) laser power; b) laser focus; c) laser scanning speed; and/or d) laser pulse duration. Processes P3 and P4 can be repeated as shown in FIG. 1, based upon the results of the imaging and the subsequent laser ablation.

In various embodiments, additional processes can include:

Process P5: coating the modified wax model 8 to form a mold shape (shell) 22. This can include depositing a liner material 21 (e.g., a metal) over the modified wax model 8 to form the mold shape (shell) 22 that outlines the modified wax model 8.

Process P6: Removing the modified wax model 8 to leave a casting mold 24 (shell) including the at least one cooling hole 10. This can include physically removing the modified wax model 8, e.g., via physical and/or chemical destruction of the modified wax model 8. In some cases, the modified wax model 8 is removed from the mold shape 22 by prying, pulling, torqueing, etc., the modified wax model 8 to leave the casting mold 24 in tact. In other cases, the modified wax model 8 is heated until liquefied (or vaporized), and is removed after heating.

Process P7: forming a shape from a casting material (e.g., a metal such as steel or alloys of steel) 32 using the casting mold 24 having the at least one cooling hole 10. Forming of the shape from the casting material 32 using the modified casting mold can include: a) pouring the casting material 32 into the casting mold 24 having the at least one cooling hole 10; and b) cooling the casting material 32 to solidify the shape. Depending upon the specific properties of the casting material 32, the cooling process can include actively cooling the casting material 32 (e.g., subjecting the casting material 32 to a cooling environment), or passively cooling the casting material 32 (e.g., allowing the casting material 32 to cool at room temperature).

Figure 3:
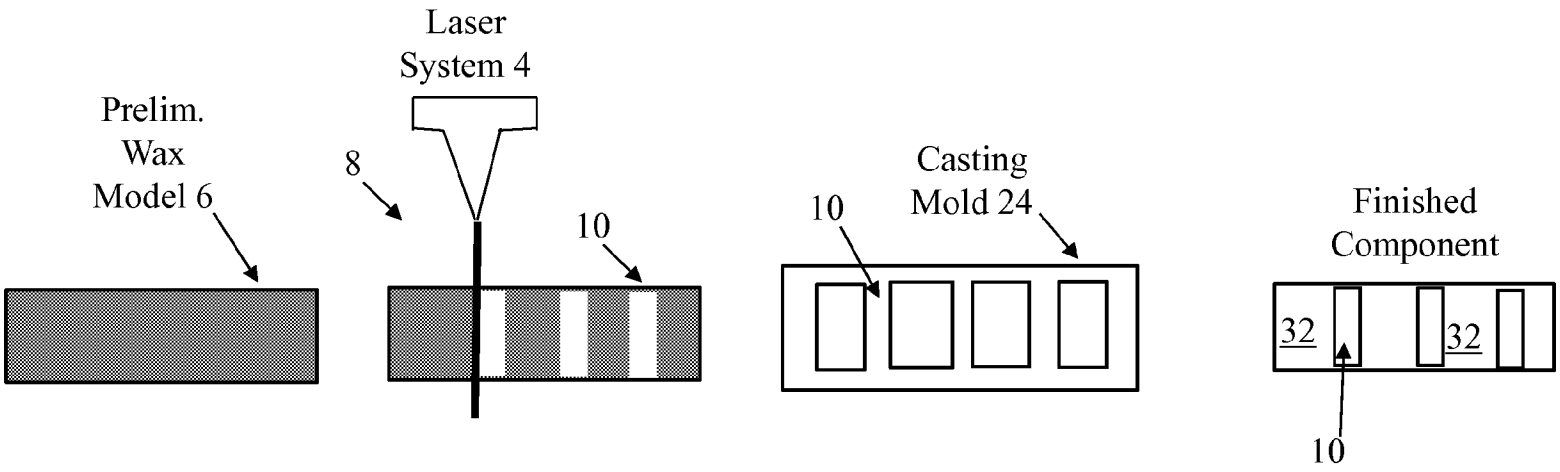
FIG. 3 shows a schematic process flow diagram illustrating processes in forming a casting shape according to various embodiments of the invention.

FIG. 3 shows a schematic process flow diagram illustrating processes in forming a casting mold 24 according to various embodiments of the invention. As shown: a preliminary wax model 6 is laser ablated to form a plurality of features 10 in the model, forming a modified wax model 8; a casting mold 24 is then formed around the modified wax model, reflecting the plurality of features 10; and in some processes, a finished component (e.g., a metal component) is formed by pouring a casting material in the casting mold 24 and subsequently removing that material 32 from the mold 24.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A method comprising:

performing laser ablation to a preliminary wax casting model to form a modified wax model of a turbomachinery part including at least one cooling hole absent from the preliminary wax casting model, wherein the performing of the laser ablation includes applying an ultra-short-pulse laser to the preliminary wax casting model to directly vaporize a portion of the preliminary wax casting model, forming the at least one cooling hole, wherein the cooling hole has an aspect ratio of approximately 5 to approximately 10;

coating the modified wax model of the turbomachinery part to form a mold shape around the modified wax model of the turbomachinery part; and removing the modified wax of the turbomachinery part model to leave a casting mold of the turbomachinery part including the at least one cooling hole.

2. The method of claim 1, further comprising forming a shape from a casting material using the casting mold having the at least one cooling hole.

3. The method of claim 2, wherein the casting material includes steel or alloys including steel.

4. The method of claim 2, wherein the forming of the shape includes:

pouring the casting material into the casting mold having the at least one cooling hole; and cooling the casting material to solidify the shape.

5. The method of claim 1, wherein the directly vaporizing includes increasing a local temperature of the portion of the preliminary wax casting model above approximately 500 degrees Celsius.

6. The method of claim 5, wherein the directly vaporizing includes maintaining a temperature of an adjacent portion of the preliminary wax casting model below approximately 120 degrees Celsius.

7. The method of claim 1, further comprising scanning the modified wax model to image the at least one cooling hole after the performing of the laser ablation.

8. The method of claim 7, wherein the scanning includes performing at least one of a two dimensional scan or a three dimensional scan of the at least one cooling hole.

9. The method of claim 8, further comprising performing a subsequent laser ablation to the modified wax model based upon the image of the at least one cooling hole.

10. The method of claim 9, wherein the subsequent laser ablation includes a modified laser ablation approach including a modified at least one of: laser power, laser focus, laser scanning speed or laser pulse duration, compared with the laser ablation.

11. A method comprising:

performing laser ablation to a preliminary wax casting model to form a modified wax model of a turbomachinery part including at least one cooling hole absent from the preliminary wax casting model, wherein the performing of the laser ablation includes applying an ultra-short-pulse laser to the preliminary wax casting model to directly vaporize a portion of the preliminary wax casting model, forming the at least one cooling hole, wherein the cooling hole has an aspect ratio of approximately 5 to approximately 10, wherein the performing of the laser ablation includes applying a pulsed laser to the preliminary wax casting model to directly vaporize a portion of the preliminary wax casting model, forming the at least one cooling hole, wherein the directly vaporizing includes:

increasing a local temperature of the portion of the preliminary wax casting model above approximately 500 degrees Celsius; and maintaining a temperature of an adjacent portion of the preliminary wax casting model below approximately 120 degrees Celsius; and scanning the modified wax model of the turbomachinery part to image the at least one cooling hole after the performing of the laser ablation.

12. The method of claim 11, further comprising performing a subsequent laser ablation to the modified wax model based upon the image of the at least one cooling hole, wherein the subsequent laser ablation includes a modified laser ablation approach including a modified at least one of: laser power, laser focus, laser scanning speed or laser pulse duration, compared with the laser ablation, wherein the pulsed laser includes an ultra-short-pulse laser.

* * * * *